US005561884A

United States Patent [19]

Nijland et al.

[11] Patent Number: 5,561,884

[45] Date of Patent: Oct. 8, 1996

[54] SUCTION ATTACHMENT, SPRAY MEMBER SUITABLE FOR IN SUCH A SUCTION ATTACHMENT, AND VACUUM CLEANER PROVIDED WITH SUCH A SUCTION ATTACHMENT

[75] Inventors: Everardus J. Nijland, Hoogeveen; Wilhelmus J. J. Maas, Someren, both of Netherlands

[73] Assignee: U.S. Philips Corporation, New York, N.Y.

[21] Appl. No.: 303,999

[22] Filed: Sep. 9, 1994

[30] Foreign Application Priority Data

Sep. 10, 1993 [BE] Belgium ..... 09300950

[51] Int. Cl.[6] ..... B08B 5/04

[52] U.S. Cl. ..... 15/321; 15/322

[58] Field of Search ..... 15/321, 322

[56] References Cited

U.S. PATENT DOCUMENTS

| | | | |
|---|---|---|---|
| 2,962,163 | 10/1954 | Geel | 15/320 X |
| 3,705,437 | 12/1972 | Rukavina et al. | 15/322 X |
| 3,747,155 | 7/1973 | Koellisch | 15/322 |
| 3,962,745 | 6/1976 | Collier | 15/322 |
| 3,964,925 | 6/1976 | Burgoon | 15/322 X |
| 4,137,600 | 2/1979 | Albishausen | 15/322 |
| 4,488,329 | 12/1984 | Lackenbach | 15/322 |
| 4,976,005 | 12/1990 | Graye | 15/322 |
| 5,210,902 | 5/1993 | Lee et al. | 15/322 X |

FOREIGN PATENT DOCUMENTS

| | | | |
|---|---|---|---|
| 0316849 | 11/1992 | European Pat. Off. . | |
| 2240467 | 8/1991 | United Kingdom | 15/322 |

*Primary Examiner*—Chris K. Moore
*Attorney, Agent, or Firm*—Ernestine C. Bartlett

[57] ABSTRACT

"Suction attachment, spray member suitable for use in such a suction attachment, and vacuum cleaner provided with such a suction attachment."

A suction attachment (1) for a vacuum cleaner (119) is provided, which suction attachment (1) has an underpressure chamber (7) with a suction opening (23, 25) and a discharge channel (9) for connection to a suction motor assembly (121) of the vacuum cleaner (119). In the underpressure chamber (7) there is an inner chamber (11) which comprises a spray member (73) for distributing a cleaning liquid over a surface to be cleaned. The spray member (73) comprises a distributor plate (79) which is positioned near an upper side (19) of the inner chamber (11) in a central position relative to an orifice (75) of the inner chamber (11). The distributor plate (79) extends parallel to the side walls (51, 53) of the inner chamber (11) and can be sprayed with the cleaning liquid from a spray nozzle (99). The use of the distributor plate (79) creates in the inner chamber (11) a plane, diverging liquid jet, so that the cleaning liquid is uniformly distributed over a major portion of the orifice (75) of the inner chamber (11) and the surface to be cleaned. The vacuum cleaner (119) is fitted with a suction motor assembly (121) which can be connected to the discharge channel (9) of the underpressure chamber (7) of the suction attachment (1) via a liquid separator (131), and with a cleaning liquid reservoir (141) which can be connected via a liquid pump (143) to the feed channel (77) of the inner chamber (11) of the suction attachment (1).

21 Claims, 3 Drawing Sheets

2/3

SUCTION ATTACHMENT, SPRAY MEMBER SUITABLE FOR IN SUCH A SUCTION ATTACHMENT, AND VACUUM CLEANER PROVIDED WITH SUCH A SUCTION ATTACHMENT

FIELD OF THE INVENTION

The invention relates to a suction attachment for a vacuum cleaner, which suction attachment is provided with an underpressure chamber which comprises a suction opening and a discharge channel for connection to a suction motor assembly, and an inner chamber arranged inside the underpressure chamber and comprising a feed channel for cleaning liquid and a spray member for distributing the cleaning liquid over an orifice of the inner chamber extending adjacent the suction opening.

The invention also relates to a spray member suitable for use in a suction attachment according to the invention.

The invention also relates to a vacuum cleaner which has a suction attachment according to the invention.

BACKGROUND OF THE INVENTION

A suction attachment of the kind mentioned in the opening paragraph is known from European Patent 0 316 849. The known suction attachment has an elongate underpressure chamber and an inner chamber which is also elongate and which extends through a central plane of the underpressure chamber, the suction opening of the underpressure chamber and the orifice of the inner chamber extending in one plane. The spray member of the known suction attachment has a distributor chamber for the cleaning liquid positioned inside the inner chamber, the feed channel for the cleaning liquid issuing into this distributor chamber. The distributor chamber is bounded by a T-shaped closing strip which extends parallel to the suction opening and whose cheeks are provided with a regular pattern of incisions. The distributor chamber is filled with the cleaning liquid through the feed channel. When the distributor chamber is substantially full, a continuous and sufficient flow of the cleaning liquid takes place through the incisions of the closing strip and the orifice of the inner chamber towards a surface to be cleaned under the influence of a liquid pressure built up in the distributor chamber. The cleaning liquid is distributed substantially uniformly over the orifice of the inner chamber and the surface to be cleaned owing to the use of the said closing strip.

A disadvantage of the known suction attachment is that a continuous and sufficient flow of the cleaning liquid is achieved only when the distributor chamber of the spray member is substantially full. Owing to the presence of the cleaning liquid in the distributor chamber, the weight to be lifted by a user during moving of the suction attachment and the pushing force to be exerted by the user on the suction attachment during shifting of the suction attachment over the surface to be cleaned are comparatively great, whereby the handling ease of the suction attachment is adversely affected. In addition, the known suction attachment drips after use because there is still cleaning liquid in the distributor chamber which flows out gradually along the closing strip to the exterior.

SUMMARY OF THE INVENTION

An object of the invention is to provide a suction attachment of the kind mentioned in the opening paragraph with which the above disadvantages are avoided, so that the handling ease of the suction attachment is improved. The invention is for this purpose characterized in that the spray member comprises a distributor plate which extends substantially parallel to a side wall of the inner chamber, which is positioned centrally relative to the orifice of the inner chamber adjacent an upper side of the inner chamber, and which is sprayable with the cleaning liquid from a spray nozzle which is connected to or in communication with the feed channel. The use of said distributor plate and said spray nozzle provides in the inner chamber a flat liquid jet which diverges away from the distributor plate and which is directed substantially parallel to the distributor plate and the side wall of the inner chamber. In this way the cleaning liquid is distributed over a major portion of the orifice of the inner chamber. The cleaning liquid flows from the feed channel and the spray nozzle directly onto the distributor plate, so that a negligibly small quantity of cleaning liquid is present in the suction attachment.

In a preferred embodiment of a suction attachment according to the invention the distributor plate is semicircular, while a spray contact point of the distributor plate is situated adjacent a circle center of the distributor plate. The use of the semicircular distributor plate with the spray contact point situated adjacent the circle center provides a substantially uniform density and an accurately defined angle of divergence of the liquid jet in the inner chamber.

In a further embodiment of a suction attachment according to the invention, the spray nozzle is connected to or in communication with the feed channel through a transverse channel which extends transversely to the feed channel. Due to the use of the transverse channel, the distributor plate can be hit by the cleaning liquid under an accurately defined spraying angle and has an accurately defined spray contact point.

In yet a further embodiment of a suction attachment according to the invention the transverse channel merges near the spray nozzle into a guide surface which extends parallel to the transverse channel and which is connected to the distributor plate via a curved portion near the circle center of the deflection of distributor plate. The use of said guide surface and said curved portion results in cleaning liquid issuing from the transverse channel in a direction determined by the guide surface and the curved portion and regular distribution of the cleaning liquid over the distributor plate, so that a particularly plane and accurately aimed liquid jet is provided in the inner chamber.

A preferred embodiment of a suction attachment according to the invention is characterized in that the feed channel, the transverse channel and the distributor plate form an integrally manufactured component which is detachably fastened to the upper side of the inner chamber. The use of said integrally manufactured component leads to a simple and fast manufacture and assembly of the suction attachment.

In a further embodiment of a suction attachment according to the invention, in which the transverse channel of the spray member is formed in a simple and practical manner, is characterized in that the transverse channel is bounded by a recess of semicircular cross-section which is provided in said component and by a flat wall provided near the upper side of the inner chamber.

In a yet further embodiment of a suction attachment according to the invention is characterized in that the inner chamber has two triangular side walls extending substantially parallel to the distributor plate, the distributor plate being arranged adjacent the apex angles of the two triangles, while the orifice of the inner chamber extends between the bases of the two triangles. Owing to the use of said side walls, the inner chamber has a shape which corresponds to the shape of a liquid jet to be generated in the inner chamber. A compact construction of the suction attachment is provided thereby, the liquid jet being distributed over substantially the entire orifice of the inner chamber.

A vacuum cleaner having a suction attachment according to the invention is characterized in that the vacuum cleaner is provided with a suction motor assembly which is connectable via a liquid separator to the discharge channel of the underpressure chamber of the suction attachment, and with a reservoir for a cleaning liquid which is connectable via a liquid pump to the feed channel of the inner chamber of the suction attachment. The cleaning liquid which is fed to a surface to be cleaned through the inner chamber of the suction attachment by the liquid pump is sucked up by the suction motor assembly via the underpressure chamber of the suction attachment and separated by the liquid separator from the air sucked along with the cleaning liquid. It is prevented in this manner that the cleaning liquid is sucked into the suction motor assembly.

BRIEF DESCRIPTION OF THE DRAWINGS

The invention will be explained in more detail below with reference to the drawing, in which.

DETAILED DESCRIPTION OF THE PREFERRED EMBODIMENTS

Figure 1:
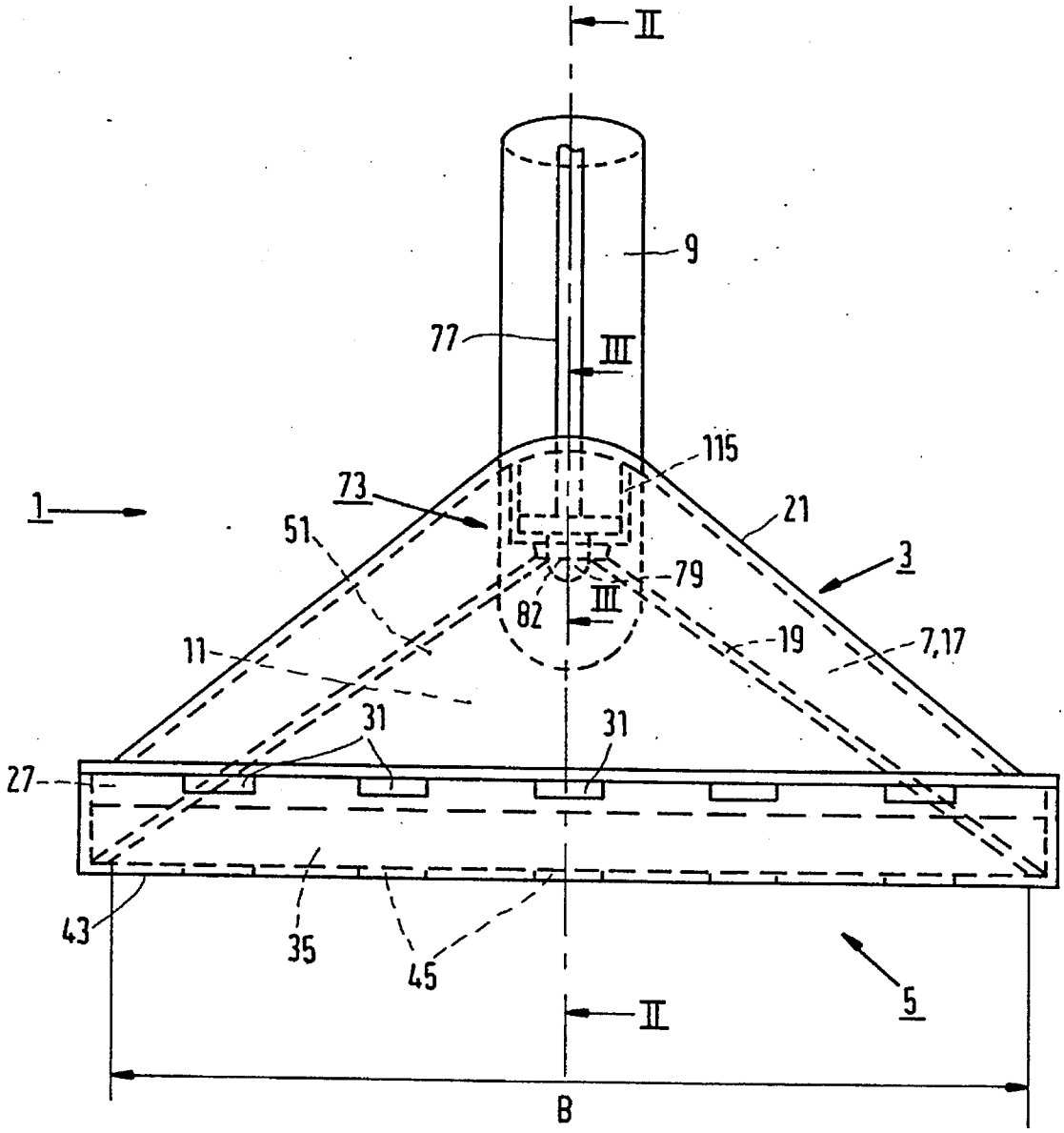
FIG. 1 is a front elevation of a suction attachment according to the invention.
Figure 2:
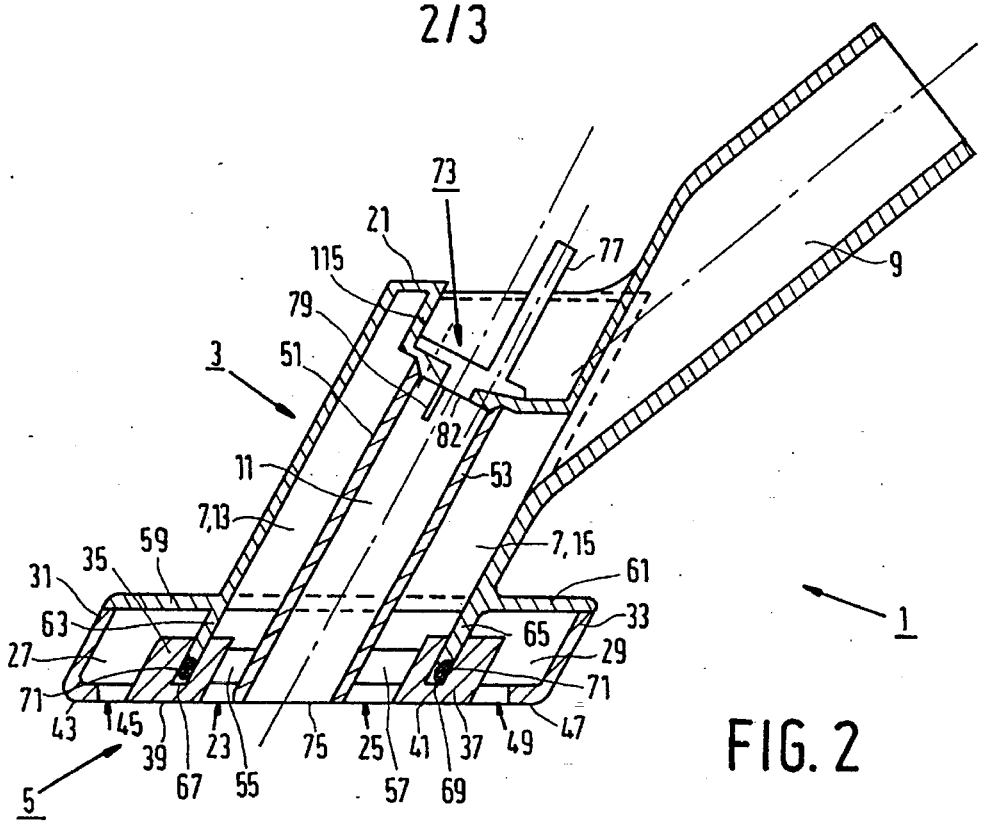
FIG. 2 is a cross-section of the suction attachment taken on the line II—II in FIG. 1.

The suction attachment 1 shown in FIGS. 1 and 2 comprises a plastic housing 3 and a plastic mouthpiece 5 which is fastened to the housing 3 by means of a screw connection not shown in FIGS. 1 and 2. In the housing 3 there is an underpressure chamber 7 which is connected to a tubular discharge channel 9 by way of which the suction attachment 1 can be connected to a suction motor assembly of a vacuum cleaner in a manner to be described, below. Inside the underpressure chamber 7 there is an inner chamber 11 which divides the underpressure chamber 7 into a front compartment 13 and a rear compartment 15. As is visible in FIG. 1, the front and rear compartments 13 and 15 are interconnected by a passage 17 which forms part of the underpressure chamber 7 and which extends between an upper side 19 of the inner chamber 17 and an upper side 21 of the underpressure chamber 7, so that both compartments 13 and 15 are connected to the discharge channel 9.

As is shown in FIG. 2, the front and rear compartments 13 and 15 issue near the mouthpiece 5 into a front suction opening 23 and a rear suction opening 25, respectively, which extend in a common plane. The mouthpiece 5 is further provided with a front suction chamber 27 and a rear suction chamber 29 which are in communication with the surroundings of the suction attachment 1 through slotted suction nozzles 31 and 33. The slotted suction nozzles 31 of the front suction chamber 27 are visible in FIG. 1. The mouthpiece 5 further comprises a front support 35 and a rear support 37 which are provided with sliding surfaces 39 and 41 at their lower sides. The sliding surfaces 39 and 41 extend in the common plane of the suction openings 23 and 25. As is further depicted in FIG. 2, the front suction chamber 27 is provided with a sliding surface 43 with slotted passages 45 near a lower side, while the rear suction chamber 29 is provided with a sliding surface 47 with slotted passages 49 near a lower side. The sliding surfaces 43 and 47 also extend in the common plane of the suction openings 23 and 25. The slotted passages 45 of the front suction chamber 27 are visible only in FIG. 1.

When the suction attachment 1 is connected to a suction motor assembly of a vacuum cleaner through the discharge channel 9, and the suction attachment 1 is placed with its sliding surfaces 39, 41, 43 and 47 on a surface to be cleaned (not shown in FIGS. 1 and 2), an underpressure will arise in the underpressure chamber 7 owing to the exhausting action of the suction motor assembly. This underpressure will generate an air flow from the front and rear suction chambers 27 and 29 through the passages 45 and 49 along the sliding surfaces 39 and 41, the suction chambers 27 and 29 being provided with air from the surroundings of the suction attachment 1 through the suction nozzles 31 and 33. Since the sliding surfaces 39 and 41 have been placed on the surface to be cleaned, dust and dirt particles present on said surface are carried along by said air flow and removed towards the suction motor assembly through the underpressure chamber 7 and the discharge channel 9.

As is further shown in FIGS. 1 and 2, the inner chamber 11 has a frontmost triangular side wall 51 and a rearmost triangular side wall 53, which side walls 51 and 53 are substantially parallel. The upper side 19 and the side walls 51 and 53 of the inner chamber 11 form one integral component with the mouthpiece 5, of which the supports 35 and 37 and the sliding surfaces 43 and 47 of the front and rear suction chambers 27 and 29 form part. The side walls 51 and 53 are connected to the front and rear supports 35 and 37 by means of lateral strips 55 and 57, respectively. FIG. 2 further shows that the housing 3 of the suction attachment 1 and the discharge channel 9 also form one integral component, of which furthermore an upper wall 59 of the front suction chamber 27, an upper wall 61 of the rear suction chamber 29, a partition wall 63 between the front compartment 13 and the front suction chamber 27, and a partition wall 65 between the rear compartment 15 and the rear suction chamber 29 form part. The partition walls 63 and 65 forming part of the housing 35 are provided in positioning grooves 67 and 69 of the front and rear supports 35 and 37, while a sealing element 71 is present between the partition walls 63, 65 and the supports 35, 37 for providing a hermetic separation between the underpressure chamber 7 and the suction chambers 27 and 29.

As is further shown in FIGS. 1 and 2, a spray member 73 is provided near the upper side 19 of the inner chamber 11. The spray member 73 is situated between the apex angles of the triangular side walls 51, 53 of the inner chamber 11, so that the spray member 73 is centrally positioned relative to an orifice or opening 75 of the inner chamber 11, which orifice or opening also extends in the common plane of the suction openings 23, 25 between the bases of the triangular side walls 51 and 53. The spray member 73 is connected to a feed channel 77 for a cleaning liquid which can be connected to a cleaning liquid reservoir of a vacuum cleaner in a manner to be described below.

Figure 3:
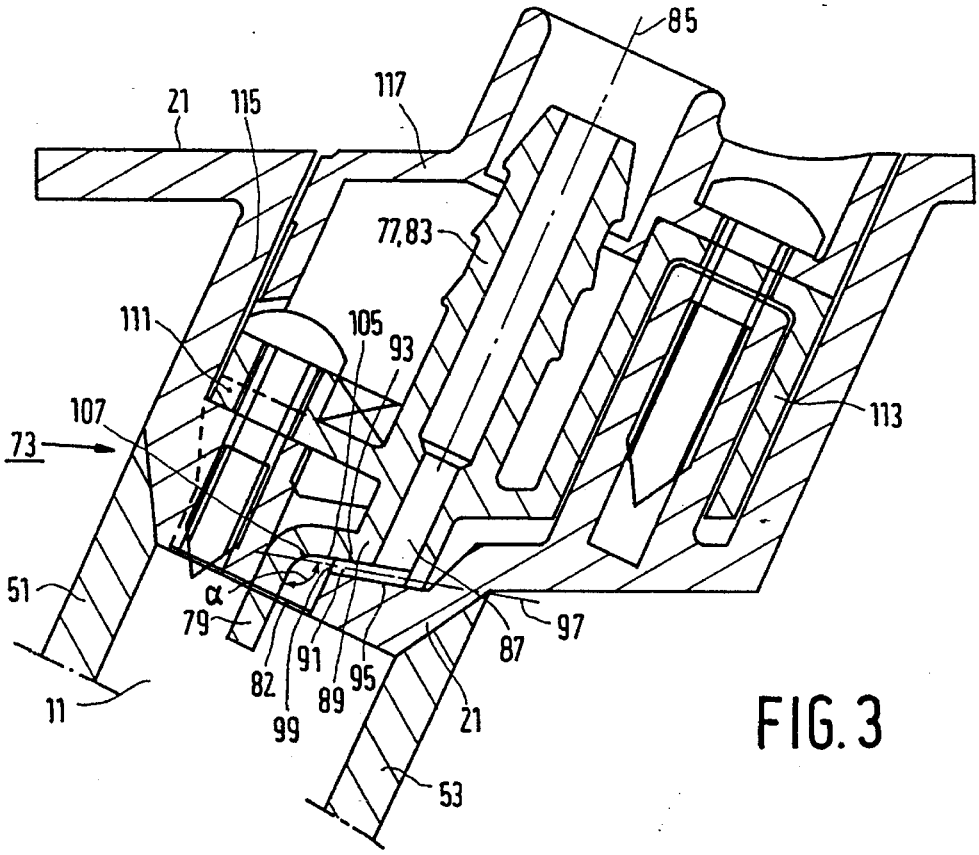
FIG. 3 is a cross-section of a spray member of the suction attachment taken on the line III—III in FIG. 1.
Figure 4:
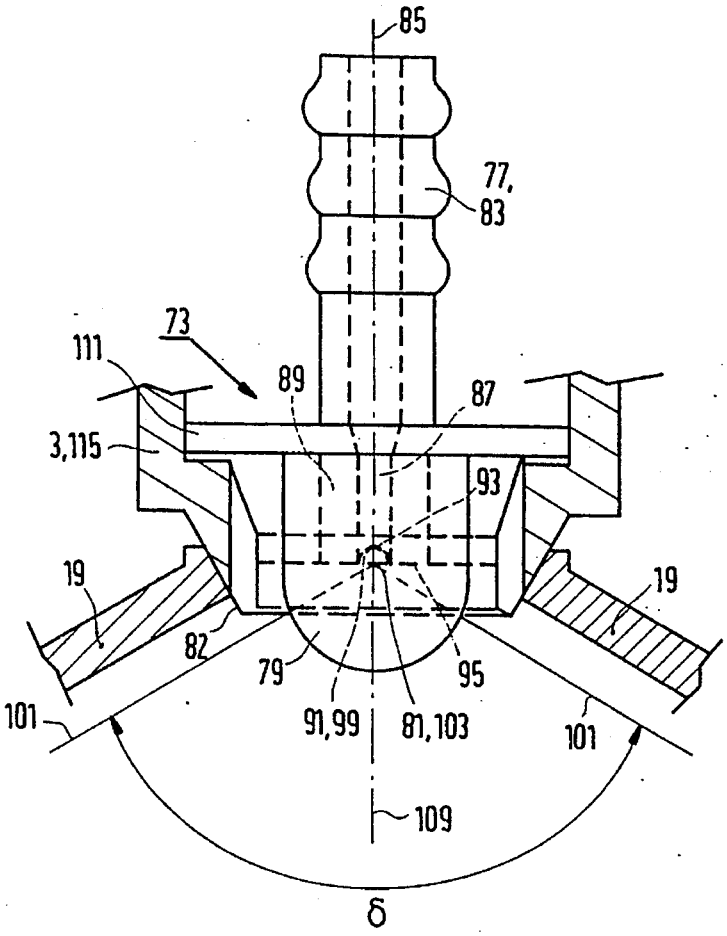
FIG. 4 is a front elevation of the spray member of FIG. 3, and FIG. 5 diagrammatically shows a vacuum cleaner provided with a suction attachment according to FIG. 1.

The spray member 73 is shown in detail in FIGS. 3 and 4. The spray member 73 comprises a semicircular distributor plate 79 with a circle center 81 which is arranged in an opening 82 in the upper side 19 of the inner chamber 11. As FIGS. 2 and 3 show, the distributor plate 79 extends substantially parallel to the parallel side walls 51 and 53 of the inner chamber 11. The feed channel 77 for the cleaning liquid comprises a nipple 83 belonging to the spray member 73 with a longitudinal axis 85 which extends substantially parallel to the distributor plate 79. The nipple 83 connects to a feed tube 87 provided in a base block 89 of the spray member 73. As FIGS. 3 and 4 show, the spray member 73 further comprises a transverse channel 91 which is bounded by a recess 93 of semicircular cross-section provided in the base block 89 and by a flat wall 95 provided in the upper side 21 of the housing 3. The transverse channel 91 has a longitudinal axis 97 which encloses a spraying angle $\alpha$ of approximately 105° with the distributor plate 79. When the suction attachment 1 is connected to a cleaning liquid reservoir of a vacuum cleaner through the nipple 83 and the cleaning liquid is supplied from the reservoir under pressure through the nipple 83, the distributor plate 79 is hit by the cleaning liquid under the spraying angle $\alpha$ from a spray nozzle 99 formed by an end of the transverse channel 91, which nozzle is connected to the nipple 83 via the transverse channel 91 and the feed tube 87. A plane liquid jet 101 diverging from the distributor plate 79 is thus created in the inner chamber 11, as shown in FIG. 4. The diverging liquid jet 10 1 is directed substantially parallel to the distributor plate 79 and the side walls 51 and 53 of the inner chamber 11, so that the cleaning liquid supplied through the nipple 83 is distributed over the orifice 75 of the inner chamber 11 and over the surface to be cleaned which is present close to the orifice 75.

As FIG. 4 shows, the distributor plate 79 is hit in a spray contact point 103 which substantially coincides with the circle center 81 of the distributor plate 79. The density of the liquid jet 101 in the inner chamber 11 is substantially uniform, while an accurately defined angle of divergence is of the liquid jet 101 is achieved (see FIG. 4). As is further shown in FIG. 3, the transverse channel 91 merges close to the spray nozzle 99 into a guide surface 105 which is directed parallel to the transverse channel 91 and which merges through a curved portion 107 into the distributor plate 79, the curved potion 107 being situated close to the circle center 81 of the distributor plate 79. The cleaning liquid issuing from the spray nozzle 99 is guided further by the guide surface 105 and the curved portion 107, deflected into a direction parallel to the distributor plate 79, and evenly distributed over the distributor plate 79. A particularly plane liquid jet 101 is thus created in the inner chamber, which jet in addition is substantially symmetrical relative to a plane of symmetry 109 of the suction attachment 1 which is shown in FIG. 4 and which contains the longitudinal axis 85 of the nipple 83. By optimizing the design of the spraying angle $\alpha$, which is accurately defined by the angle enclosed by the longitudinal axis 97 of the transverse channel 91 with the distributor plate 79, the radius of curvature of the curved portion 107, the radius of the semicircular distributor plate 79, and the pressure of the supplied cleaning liquid, an angle of divergence $\delta$ of the liquid jet 101 is achieved which is substantially equal to the apex angle of the triangular side walls 51, 53 of the inner chamber 11. The cleaning liquid is thus uniformly distributed over substantially the entire width B of the orifice 75 of the inner chamber 11 (see FIG. 1), so that a major portion of the surface to be cleaned is treated with cleaning liquid.

It is noted that only a small quantity of cleaning liquid is present in the nipple 83, the feed tube 87 and the transverse channel 91 during operation. After use of the suction attachment 1, accordingly, the suction attachment 1 substantially does not drip. The weight of the cleaning liquid present in the nipple 83, the feed tube 87 and the transverse channel 91 is negligibly small and thus does not influence the total weight of the suction attachment 1 and the sliding force required for moving the suction attachment 1 over the surface to be cleaned.

As is further shown in FIG. 3, the distributor plate 79, the guide surface 105, the base block 89 with the transverse channel 91 and the feed robe 87, and the nipple 83, all belonging to the spray member 73, form an integral component injection-moulded from a synthetic resin. A fastening plate 111 and a fastening bracket 113, by means of which the spray member 73 is detachably fastened in a chamber 115 forming part of the housing 3, also belong to the said component. FIG. 3 further shows a cover 117 with which the chamber 115 can be closed. The spray member 73 and the cover 117, manufactured as an integral component, can be quickly and simply provided in the chamber 115. The transverse channel 91 is formed between the base block 89 and the flat wall 95 in the manner described above during fastening of the spray member 73.

Figure 5:
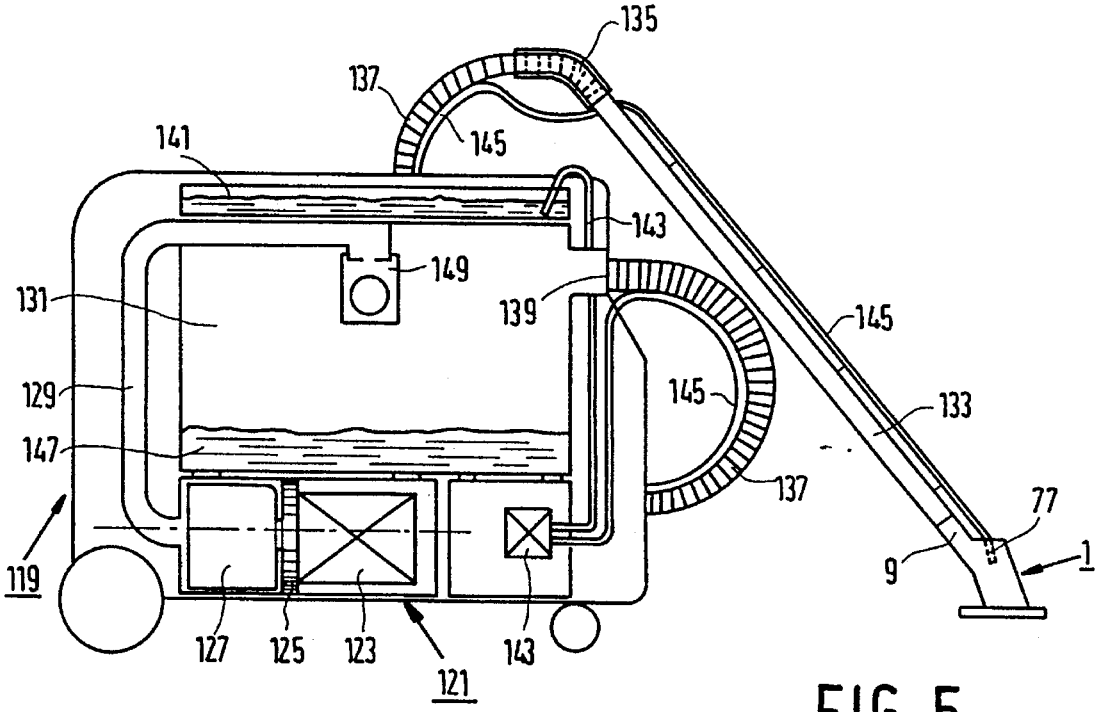

FIG. 5 diagrammatically shows a vacuum cleaner 119 provided with a suction attachment 1 as shown in FIGS. 1 and 2. The vacuum cleaner 119 is provided with a suction motor assembly 121 with an electric motor 123, a blade wheel 125 which can be driven by the electric motor 123, and a dust compartment 127. The suction motor assembly 121 is connected to a liquid separator 131 through a channel 129. As is further shown in FIG. 5, the discharge channel 9 of the suction attachment 1 is connected to a hollow tube 133 which is provided at one end with a handle 135. The hollow robe 133 is connected to an input 139 of the liquid separator 131 through a flexible hose 137. The vacuum cleaner 119 is further provided with a reservoir 141 for a cleaning liquid. The reservoir 141 is connected through a line 143 to an electric liquid pump 143 which in its turn is connected to the feed channel 77 of the suction attachment 1 through a flexible line 145 arranged parallel to the hose 137 and the tube 133. During operation, the cleaning liquid is forced by the liquid pump 143 from the holder 141 under pressure to the suction attachment 1. The cleaning liquid provided to the surface to be cleaned is sucked up together with the dust and dirt particles present on said surface by the suction attachment 1 and removed through the hose 137 to the liquid separator 131 under the influence of an underpressure generated in the suction attachment 1 and in the liquid separator 131 by the exhausting action of the blade wheel 125 driven by the electric motor 123. In the liquid separator 131, the collected cleaning liquid with any dust and dirt particles dissolved therein are caught in a bottom portion 147 of the liquid separator 131 under the influence of gravity. The remaining dust and dirt particles are sucked into the channel 129 through a float chamber 149, which prevents the cleaning liquid being sucked into the channel 129 and into the suction motor assembly 121 when the liquid separator 131 is full. Finally, the dust and dirt particles sucked into the channel 129 are filtered from the air flow in the dust compartment 127 and collected.

It is noted that the spray member 73 described above can also be used in a suction attachment in which the inner chamber and the underpressure chamber are differently arranged relative to one another compared with the inner chamber 11 and the underpressure chamber 7 of the suction attachment 1 shown in FIGS. 1 and 2. The inner chamber and the underpressure chamber may, for example, have a shared side wall. Furthermore, the inner chamber may alternatively be provided with non-parallel side walls, for example, diverging from one another from the top of the inner chamber towards the orifice of the inner chamber. It is also possible for the side walls of the inner chamber to have a different shape, for example, a rectangular or parallelogram shape.

It is further noted that the distributor plate, depending on the desired shape of the liquid jet to be generated in the inner chamber, may have a different shape such as, for example, elliptical, square, or rectangular with rounded comers.

It is also noted that the transverse channel may also have a different cross-section, for example, a square or circular cross-section. The spray member may also be constructed without a transverse channel. Thus, for example, the spray nozzle may alternatively be provided in a side wall of the feed channel.

We claim:

1. A suction attachment for a vacuum cleaner, which suction attachment is provided with an underpressure chamber which comprises a suction opening and a discharge channel for connection to a suction motor assembly, and an inner chamber arranged inside the underpressure chamber and comprising a feed channel for cleaning liquid and a spray member for distributing the cleaning liquid through an opening of the inner chamber extending adjacent the suction opening, wherein the spray member comprises a distributor plate which extends substantially parallel to a wall of the inner chamber, which distributor plate is positioned centrally relative to the opening of the inner chamber adjacent an upper side of the inner chamber, and which distributor plate is sprayable with the cleaning liquid from a spray nozzle which is in communication with the feed channel.

2. A suction attachment as claimed in claim 1, wherein the distributor plate is semicircular, while a spray contact point of the distributor plate is situated adjacent a central point of the distributor plate.

3. A suction attachment as claimed in claim 2, wherein the transverse channel merges near the spray nozzle adjoins a guide surface which extends parallel to the transverse channel and which is connected to the distributor plate via a curved portion near a central point of the distributor plate.

4. A suction attachment as claimed in claim 3, wherein the inner chamber has two triangular walls extending substantially parallel to the distributor plate, the distributor plate being arranged adjacent the apex angles of the two triangles, while the orifice of the inner chamber extends between the bases of the two triangles.

5. A vacuum cleaner comprising a suction attachment as claimed in claim 3, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

6. A suction attachment as claimed in claim 2, wherein the spray nozzle is in communication with the feed channel through a transverse channel which extends transversely to the feed channel.

7. A suction attachment as claimed in claim 2, wherein the inner chamber has two triangular walls extending substantially parallel to the distributor plate, the distributor plate being arranged adjacent the apex angles of the two triangles, while the orifice of the inner chamber extends between the bases of the two triangles.

8. A vacuum cleaner comprising a suction attachment as claimed in claim 2, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

9. A suction attachment as claimed in claim 1, wherein the spray nozzle is in communication with the feed channel through a transverse channel which extends transversely to the feed channel.

10. A suction attachment as claimed in claim 4, wherein the feed channel, the transverse channel and the distributor plate form an integrally manufactured component which is detachably fastened to the upper side of the inner chamber.

11. A suction attachment as claimed in claim 10 wherein the transverse channel is bounded by a recess of semicircular cross-section which is provided in said component and by a flat wall provided on the upper side of the inner chamber.

12. A suction attachment as claimed in claim 11, wherein the inner chamber has two triangular walls extending substantially parallel to the distributor plate, the distributor plate being arranged adjacent the apex angles of the two triangles, while the orifice of the inner chamber extends between the bases of the two triangles.

13. A vacuum cleaner comprising a suction attachment as claimed in claim 11, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

14. A suction attachment as claimed in claim 10, wherein the inner chamber has two triangular walls extending substantially parallel to the distributor plate, the distributor plate being arranged adjacent the apex angles of the two triangles, while the orifice of the inner chamber extends between the bases of the two triangles.

15. A vacuum cleaner comprising a suction attachment as claimed in claim 10, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

16. A suction attachment as claimed in claim 9, wherein the transverse channel near the spray nozzle adjoins a guide surface which extends parallel to the transverse channel and which is connected to the distributor plate via a curved portion near a central point of the distributor plate.

17. A suction attachment as claimed in claim 9, wherein the inner chamber has two triangular walls extending substantially parallel to the distributor plate, the distributor plate being arranged adjacent the apex angles of the two triangles, while the orifice of the inner chamber extends between the bases of the two triangles.

18. A vacuum cleaner comprising a suction attachment as claimed in claim 9, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

19. A suction attachment as claimed in claim 1, wherein the inner chamber has two triangular side walls extending substantially parallel to the distributor plate, the distributor plate being arranged adjacent the apex angles of the two triangles, while the orifice of the inner chamber extends between the bases of the two triangles.

20. A vacuum cleaner comprising a suction attachment as claimed in claim 19, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

21. A vacuum cleaner comprising a suction attachment as claimed in claim 1, wherein the vacuum cleaner comprises a suction motor assembly which is connectable via a liquid separator to the discharge channel of the underpressure chamber of the suction attachment, and a reservoir for a cleaning liquid which is connectable via a liquid pump to the feed channel of the inner chamber of the suction attachment.

* * * * *